US005651910A

United States Patent [19]

Myers et al.

[11] Patent Number: 5,651,910

[45] Date of Patent: Jul. 29, 1997

[54] CONCRETE WALL FORM AND TIE SYSTEM

[75] Inventors: Dallas E. Myers, 4301 Fisher Ave., Middletown, Ohio 45067; Norman Cottongim, Trenton, Ohio; Glynn Neumann, Burnsville, Minn.

[73] Assignee: Dallas E. Myers, Middletown, Ohio

[21] Appl. No.: 556,801

[22] Filed: Nov. 2, 1995

[51] Int. Cl.[6] ..... E04G 17/06

[52] U.S. Cl. ..... 249/41; 249/45; 249/189; 249/190; 249/191; 249/214

[58] Field of Search ..... 249/40, 41, 44, 249/45, 189, 190, 191, 214, 218

[56] References Cited

U.S. PATENT DOCUMENTS

| | | | |
|---|---|---|---|
| 1,224,810 | 5/1917 | Tenholder . | |
| 1,293,391 | 2/1919 | Ewing . | |
| 1,367,438 | 2/1921 | Strausbaugh . | |
| 1,729,807 | 10/1929 | Toogood . | |
| 2,268,883 | 1/1942 | Lind | 249/214 |
| 2,411,678 | 11/1946 | Cornella . | |
| 2,750,647 | 6/1956 | Krieg . | |
| 2,784,476 | 3/1957 | Bergdal | 249/218 |
| 3,010,175 | 11/1961 | Shoemaker | 249/41 |
| 3,055,076 | 9/1962 | Van Helden et al. . | |
| 3,074,141 | 1/1963 | Bowden et al. | 249/214 |
| 3,168,772 | 2/1965 | Williams . | |
| 3,236,490 | 2/1966 | Lovgren et al. | 249/45 |
| 3,327,986 | 6/1967 | Oury | 249/45 |
| 3,381,929 | 5/1968 | Bancker . | |
| 3,420,491 | 1/1969 | Bowden et al. . | |
| 3,430,913 | 3/1969 | Johnson . | |
| 3,432,137 | 3/1969 | Krajco | 249/45 |
| 3,437,306 | 4/1969 | Gates . | |
| 3,477,684 | 11/1969 | Dagiel . | |
| 3,529,800 | 9/1970 | Gates . | |
| 3,625,470 | 12/1971 | Shoemaker . | |
| 3,653,628 | 4/1972 | Shoemaker . | |
| 3,661,354 | 5/1972 | Dagiel et al. . | |
| 3,690,613 | 9/1972 | Shoemaker | 249/41 |
| 3,734,453 | 5/1973 | Bailey . | |
| 3,785,610 | 1/1974 | Dagiel . | |
| 3,972,501 | 8/1976 | Plough . | |
| 3,981,476 | 9/1976 | Alexander et al. . | |
| 4,027,846 | 6/1977 | Caplat | 249/189 |
| 4,030,694 | 6/1977 | Schimmel . | |
| 4,062,514 | 12/1977 | Scott-King . | |
| 4,070,845 | 1/1978 | Cody . | |
| 4,150,808 | 4/1979 | Sawyer | 249/189 |
| 4,158,452 | 6/1979 | Gates . | |
| 4,210,306 | 7/1980 | Schimmel . | |
| 4,211,385 | 7/1980 | Johanson et al. | 249/45 |
| 4,239,173 | 12/1980 | Sawyer | 249/214 |

(List continued on next page.)

FOREIGN PATENT DOCUMENTS

| | | | |
|---|---|---|---|
| 193120 | 11/1957 | Austria | 249/218 |
| 2364314 | 5/1978 | France | 249/218 |
| 209067 | 11/1966 | Sweden | 249/214 |

*Primary Examiner*—James P. Mackey
*Attorney, Agent, or Firm*—Wood, Herron & Evans, L.L.P.

[57] ABSTRACT

A wall form system for use in constructing a poured concrete wall includes a plurality of panels aligned in an edge-to-edge configuration to form spaced wall forms. The wall forms are maintained in a spaced relationship by a tie which includes a pair of cutouts which mate with notches in the side edges of each of the panels at the juncture between adjacent panels. A retainer is provided to secure each end of the tie to the outer face of the adjacent panels. After the concrete wall is poured and hardened, the wall forms are easily disassembled by breaking a first frangible section from the tie and removing the wall form panels and then breaking a second frangible section from the tie which is projecting from the concrete wall. The ties and retainers are disposable and easily assembled with the wall forms thereby alleviating the need for collection and retrieval when the wall forms are disassembled. Further, the wall panels consist of multi-layer composite construction which provides sufficient strength and durability to the wall form system with a lightweight and easily handled and maneuvered panel that can be reused for subsequent poured concrete wall applications.

16 Claims, 5 Drawing Sheets

U.S. PATENT DOCUMENTS 4,247,073 1/1981 Vario .
4,300,747 11/1981 Brow ..... 249/218
4,417,425 11/1983 Case et al. .
4,889,310 12/1989 Boeshart ..... 249/214
5,050,365 9/1991 Edgar et al. .
5,098,059 3/1992 Sawyer ..... 249/189
5,119,567 6/1992 Fox .
5,191,718 3/1993 Fox .

CONCRETE WALL FORM AND TIE SYSTEM

BACKGROUND OF THE INVENTION

The present invention relates to a system for pouring concrete walls, and more particularly to tie and panel designs for use in constructing a wall form for a poured concrete wall.

Many present day poured concrete walls are constructed using prefabricated, reusable, interlocking panels. A plurality of the panels are interconnected to construct a pair of generally parallel and spaced wall forms. After the wall forms are constructed, the concrete is poured therebetween and permitted to harden or cure and the wall forms are disassembled and removed from the hardened concrete wall for subsequent reuse. The panels are necessarily of relatively high strength and are typically constructed of plywood, steel and/or aluminum and are designed to be interconnected in a side-by-side relationship.

Known panels generally include flanges which extend perpendicularly from a back face of the panel along each side edge. A series of spaced openings are provided in the flanges. When the panels are placed in juxtaposition with each other the adjacent flanges are typically interconnected by slotted pins and wedges which are separate from the panels. The slotted pins are driven through the aligned openings in the flanges and the wedge is then placed within the pin slot to lock the individual panels together. When the wall form is to be disassembled, the wedges are loosened and removed and the pins extracted from the apertures in the flanges and collected for reuse.

Use of traditional detached panel connection hardware presents a number of problems. Specifically, many of the pins and wedges are lost during the normal process of form construction and disassembly. Commonly, the pins and/or wedges fall on the ground at the construction site, in a hole, puddle or the like and simply are not or cannot retrieved by the worker. As a result, a significant number of the pins and wedges are lost which over time can be very expensive to replace.

Moreover, use of detachable hardware as described can be very labor intensive inasmuch as the panels must be held in alignment while the connection hardware is first properly positioned and then driven into place. Further, the transportation, distribution, installation and collection of the large number of pins and wedges required at a typical construction site has proven to be very time consuming and labor intensive.

In response to the problems associated with detachable and reusable panel connection hardware, attempts have been made at developing assemblies which are permanently secured to the panels. One such assembly includes a pin or a bolt which is shiftably mounted adjacent to the flange of a panel for passage through aligned flange apertures to connect the adjacent panels. Additionally, the pin includes a groove proximate the tail end thereof which is adapted to receive a locking wedge when the pin is in its retracted position to thereby maintain the pin in this position and allow for storage of the wedge.

Another attached hardware system includes a tapered pin having a rearward extension which is received within a slide block. The slide block incudes a disk designed to maintain the position of the locking pin relative to each flange aperture. The pins are driven forwardly to pass through aligned apertures of adjacent panels and a tapered wedge is used to complete the panel connection.

A number of drawbacks are associated with attached hardware systems. Specifically, such known connection systems add significant weight to the panels. A large number of panels are typically transported to a construction site and this added weight increases the transportation time and handling of the panels. Further, over time attached hardware connections become significantly misaligned or loose due to normal wear of the components. This is primarily objectionable because as a result the installer must manually align the components before panel connection can be completed.

In addition to the problems described with respect to known hardware for connecting the panels together, the current panels themselves have significant shortcomings. First of all, the panels can be quite heavy, typically weighing about 90 pounds or more each. Usually a single worker manipulates the panels and moves them around on the job site. Therefore, a lighter weight panel could not only reduce material and shipping costs, but increase labor productivity while minimizing potential injuries to the workers who handle the panels. However, lighter panels typically suffer the problem of providing insufficient strength or structural integrity to the assembled wall form. The concrete poured between the assembled panels acts substantially like a fluid and delivers significant hydrostatic pressures to the wall forms. The pressure naturally becomes greater toward the bottom of the forms. Typically, the compressive load on a concrete form eight feet high can easily reach 1,000 to 1,200 pounds per square foot. The panel, connection hardware and assembled wall form must be able to withstand these pressures without buckling, deformation or failure.

Furthermore, since the forces are not evenly distributed over the panels, the panels may shift and spread relative to one another thereby inducing significant forces on the interconnecting hardware of the panels. Further, the concrete expands as it sets creating additional forces on the wall form system and ties. In a typical concrete wall, there may be as much as 5,000 pounds of tension or pulling force or load on an individual tie which extends between the spaced wall forms.

It has therefore been a primary objective of this invention to provide tie and panel connection hardware for use with concrete wall forms which can be easily and economically used at the construction site.

It has been a further objective of this invention to provide interlocking hardware for joining the adjacent panels of a wall form together which can be easily, efficiently and economically installed and removed during assembly and disassembly of the wall forms.

It has been a further objective of this invention to provide such panel connection hardware which does not add weight to the panels but maintains a secure alignment and interconnection of the panels under the high loads applied to the wall forms.

It has been a yet further objective to provide a tie and interlocking connection for the adjacent panels which is strong enough to withstand the forces generated in the construction of a poured concrete wall.

It has also been a primary objective of this invention to provide an improved panel for use in constructing a wall form which is both lightweight and strong enough to withstand the forces generated in the construction of the poured concrete wall.

SUMMARY OF THE INVENTION

These and other objectives of the invention have been attained by the present invention which includes a tie design which has a retainer to connect to the adjacent panels. A retainer is preferably preassembled on each end of the tie. As with known systems, a plurality of panels cooperate to construct each wall form system. Adjacent panels according to this invention are interconnected by the tie and associated retainers. A number of notches are provided in the side edges of each of the panels and the notches of adjacent panels are intended to be aligned with each other. Each pair of aligned notches is adapted to mate with a tie that extends between the opposed wall forms. Each end of each tie has a pair of cutouts which are seated within the aligned notches on the panels which secure the wall forms in a predetermined spaced relationship.

Each tie has a retainer secured on each end thereof proximate the cutouts. The retainer bridges the intersection between the adjacent panels. Each retainer has a pair of pins, nails or other fasteners which can be driven through the retainer and into a hole in each panel. As a result, the pins in the retainers maintain the adjacent side edges of the panels in an abutting and secure relationship. In a presently preferred embodiment, each panel includes a retainer plate having a hole formed therein proximate the notch to receive the fastener from the retainer. As a result, the tie, retainers and fasteners can be preassembled by the manufacturer and preferably delivered as a single unit to the construction site for installation with the panels while constructing the wall forms. Therefore, the workers at the construction site are not required to assemble the panel connection hardware thereby minimizing the time and labor required in constructing the wall forms.

Each end of each tie according to this invention includes two frangible sections which provide for the easy and efficient disassembly of the wall forms and panels. After the concrete has been poured between the wall forms and has cured, the first frangible section is broken from each tie by a worker with a hammer or the like. In a presently preferred embodiment, the cutouts which mate with the notches in the panels in part define the frangible sections on each end of the tie. Further, when the first frangible section is broken from each end of the tie, preferably the associated retainer is also dislodged from the adjacent panels. After the first frangible section and retainer from each of the ties have been broken away from the wall form, the panels can be removed from the hardened concrete wall thereby exposing the second frangible section of each tie which projects from the concrete wall. The second frangible section is merely broken by the worker with a hammer or the like thereby leaving the remaining middle portion of each tie embedded within the concrete wall. As is well known in the art, a cavity or other portion of the concrete wall proximate the tie may require patching or grout to provide a smooth and finished surface for the concrete wall as desired.

The tie and panel connection hardware of this invention are disposable thereby alleviating the need for the collection of the various components during disassembly of the wall forms. Further, because of the dual frangible sections on each end of the tie, the wall forms can be easily disassembled by merely breaking them away during the disassembly of the wall forms.

The present invention also encompasses an improved panel design for use in wall forms for poured concrete walls. The panel according to this invention includes a rigid foam core with a frame extending around the bottom, top and side edges of the core. The foam core and frame are sandwiched between opposing face sheets which in one different embodiments may consist of a single layer or composite layers of aluminum, shock absorbing material and/or a polycarbonate outer protective layer. In each of the embodiments, the panel according to this invention is significantly lighter, approximately one third of the weight of known panels. Further, the panel has been tested to provide adequate strength to withstand the forces applied thereto by the poured concrete and curing concrete wall. Once the wall forms are disassembled, the individual panels according to this invention can be reused in subsequent poured concrete wall applications. Advantageously, each panel is symmetric and as such reversible so that time and effort is not required of the worker to properly orient the panels.

The wall form system according to this invention provides lightweight, easily maneuverable panels with ties and retainers that can be easily assembled and installed with the wall forms. Further, the ties and retainers are easily disassembled by the construction worker and do not require the collection and retrieval of individual components after disassembly while providing sufficient strength and alignment of the adjacent panels.

BRIEF DESCRIPTION OF THE DRAWINGS

The objectives and features of the invention will become more readily apparent from the following detailed description taken in conjunction with the accompanying drawings in which.

DETAILED DESCRIPTION

Figure 1:
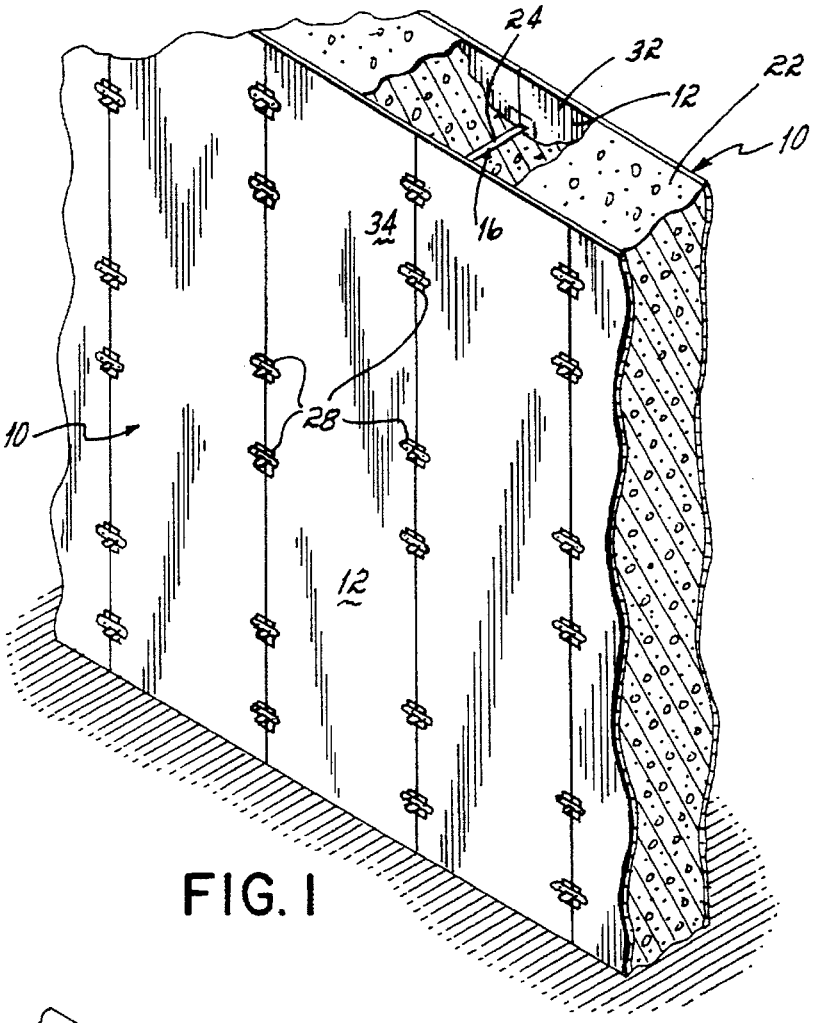
FIG. 1 is a perspective view of a pair of wall forms with concrete poured therebetween in which each wall form is constructed by a plurality of panels secured together in side-by-side relationship with a plurality of ties and retainers according to presently preferred embodiments of this invention.

Referring to FIG. 1, a pair of wall forms 10 are shown in generally parallel and spaced relationship to one another. Each wall form 10 is constructed from a plurality of panels 12 aligned in side-by-side relationship in which each panel has a pair of opposing side edges 14 and the side edge 14 of one panel 12 is preferably maintained in an abutting and contacting relationship with an adjacent side edge 14, of an adjacent panel 12. A plurality of ties 16 extend between the spaced wall forms 10 and are located at the juncture between the adjacent panels 12. A retainer 18 is located proximate each end 20 of each tie 16 to secure the tie 16 to the adjacent panels 12. After the wall forms 10, ties 16, retainers 18 and panels 12 are assembled as shown in FIG. 1, concrete 22 is poured in the space between the wall forms 10 thereby embedding a middle portion 24 of each tie 16 located between the wall forms 10. The concrete 22 is allowed to cure or harden and then the wall forms 10 and portions of the ties 16 are removed as will be described later herein. The panels 12 can be reused for the construction of subsequent concrete walls.

Figure 2:
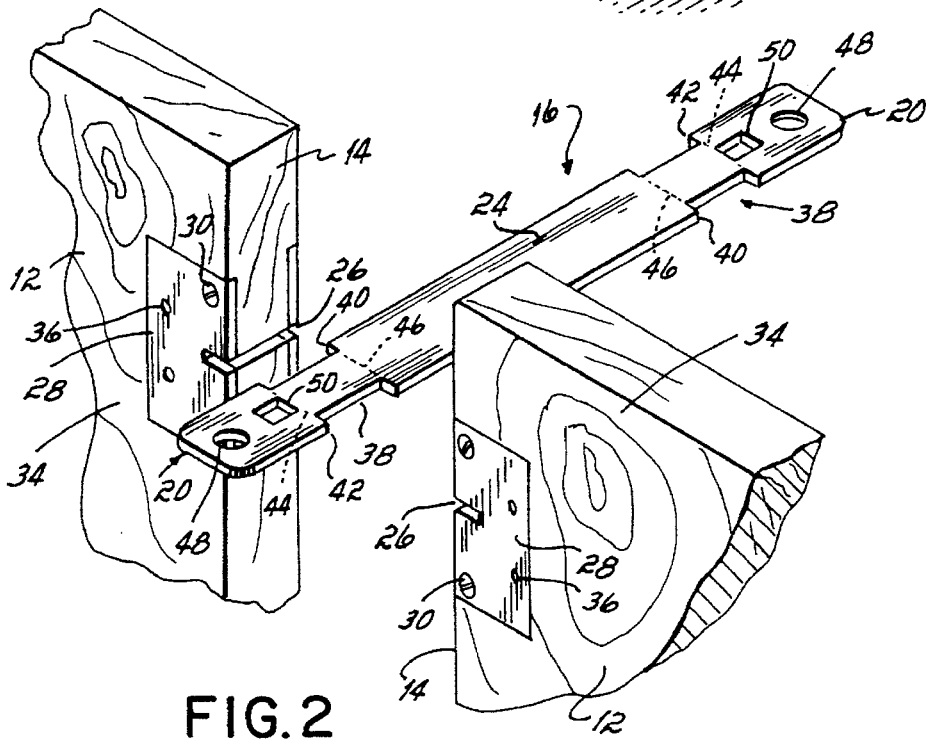
FIG. 2 is an enlarged perspective view showing a preferred embodiment of a tie according to this invention being installed into notches on adjacent wall form panels.

As shown in FIG. 1 and particularly FIG. 2, each side edge 14 of each panel 12 includes a plurality of notches 26, preferably six, spaced along the side edge 14. The notches 26 are positioned to be aligned with corresponding notches 26 on the adjacent side edge 14 of the adjacent panel 12. A retainer plate 28 is secured by a pair of screws 30 to an inner face 32 and an outer face 34 of each panel 12 at each notch 26 location. The retainer plates 28 are preferably embedded within the respective faces 32, 34 of the panel 12 to present a generally planar panel face. The panel 12 of FIGS. 1 through 7 is shown as being constructed of wood primarily for exemplary purposes and it will be appreciated that other panel materials and designs, such as those described later herein or others, can be employed within the scope of this invention.

Preferably, each retainer plate 28 measures one inch in width and two inches in height and is one-eighth inch thick cold rolled steel. The notch 26 extends 0.33 inches from the side edge 14 of the panel 12 and is preferably 0.125 inches wide. A pair of holes 36 are provided in each retainer plate 28 and are preferably spaced 0.75 inches from the side edge 14 of the panel 12 and 0.75 inches apart and equally spaced above and below the notch 26. The purpose of the holes 36 will be described later herein.

A presently preferred embodiment of the tie 16 according to this invention is particularly shown in FIG. 2. The tie 16 is preferably die punched from 0.08 inch thick cold rolled steel. Each tie 16 includes the middle portion 24 which is embedded in concrete 22 between the spaced wall forms 10 and a pair of similarly configured ends 20 spaced on either end of the middle portion 24. The middle portion 24 is preferably eight or ten inches in length according to alternative preferred embodiments of the tie 16 depending on the desired spacing between the wall forms 10 and the width of the concrete wall to be poured.

A rectangular cutout 38 is formed in each side edge of the tie 16 at each end 20 thereof. Each cutout 38 is preferably two inches in length and 0.3 inches in depth. The tie 16 is preferably 3½ inches from an inner edge 40 of the cutout to the terminal end of the tie 16. As a result, the total length of the tie 16 for presently preferred embodiments is 15 or 17 inches.

The cutouts 38 in part define a first frangible section of the tie 16 which extends between an outer edge 42 of each cutout 38 on each end 20 of the tie 16 to the terminal end of the tie 16 and is shown, in part, by first frangible section shown by dashed line 44 in FIG. 2. A second frangible section, shown by a dashed line 46, is provided on each tie 16 and is defined at the inner edge 42 of the cutouts 38 at each end 20 of the tie 16. A half inch diameter circular hole 48 is provided proximate the end 20 of each tie 16 to accommodate a waler system (not shown) which system is well known to one of ordinary skill in the art and forms no part of the present invention. The first presently preferred embodiment of the tie 16 according to this invention is shown in FIG. 2 and includes a rectangular hole 50 positioned on the centerline of the tie 16 between the circular hole 48 and cutouts 38. Preferably, the axial dimension of the rectangular hole 50 is three-eighths of an inch and the lateral dimension is one-quarter of an inch.

Figure 3:
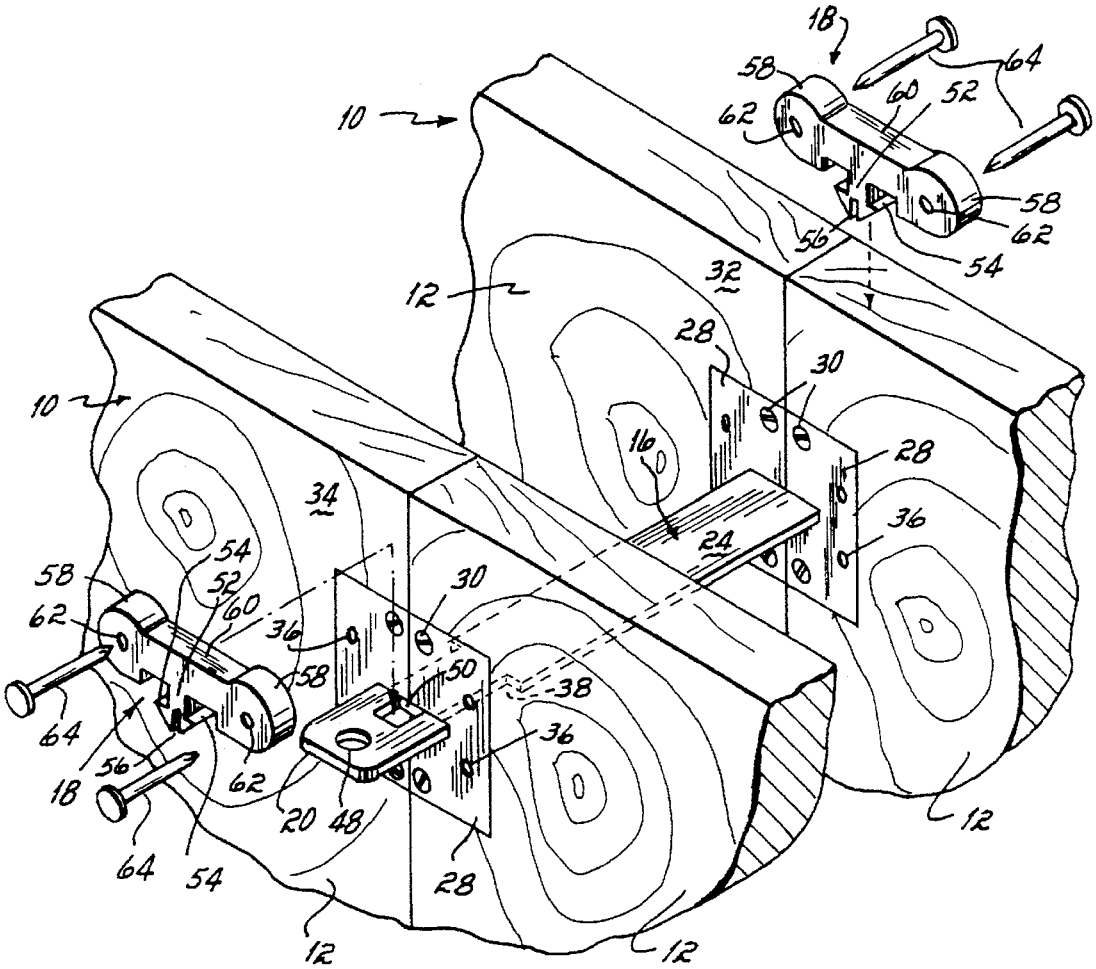
FIG. 3 is an enlarged perspective view of the tie secured in the panels forming spaced wall forms and a first embodiment of a retainer and fastener being secured to the tie and wall form panels.
Figure 4:
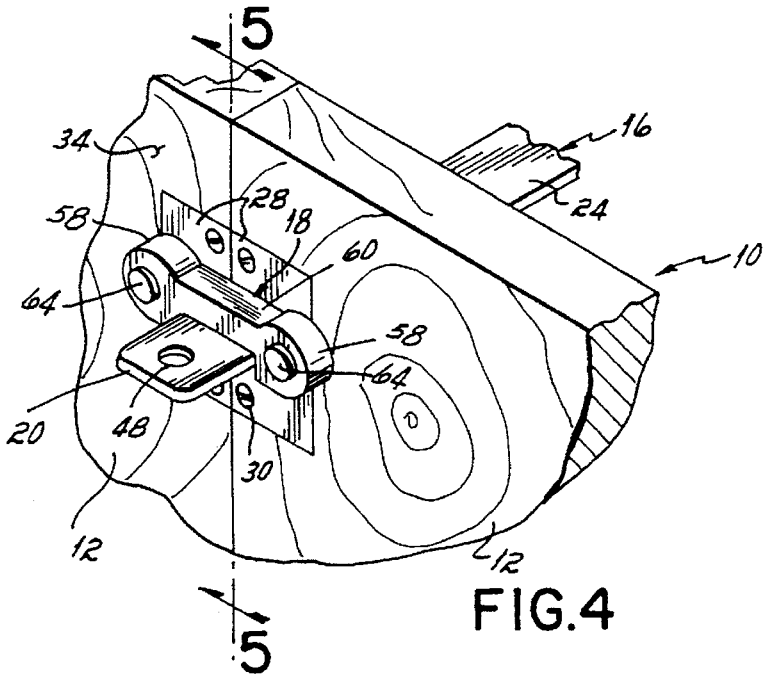
FIG. 4 is an enlarged perspective view of the first embodiments of the tie, retainer and fasteners secured to adjacent panels of the wall form.

As shown particularly in FIGS. 3 and 4, the cutouts 38 are seated within the notches 26 provided in the side edges 14 of the panels 12 and as such define a predetermined spacing between the opposing panels 12 of the spaced wall forms 10. The spacing between the opposed panels 12 forming the wall forms 10 is maintained as shown in FIG. 3 as the outer edge 42 of each cutout 38 is seated on the retainer plate 28 of the outer face 34 and the inner edge 40 of each cutout 38 is seated on the retainer plate 28 of the inner face 32 of the adjacent panels 12. Therefore, outwardly directed force or pressure generated by the pouring of the concrete 22 and its expansion during hardening or curing is resisted by the outer edge 42 of the cutout 38. Likewise, the spacing between the wall forms 10 is maintained by the inner edges 40. Advantageously, the retainer plate 28 provides added strength and security to resist movement of the panels 12 which are seated on the ties 16.

A first presently preferred embodiment of a retainer 18 is shown in FIGS. 3 and 4 and includes a downwardly extending bifurcated lug 52 having a pair of deflectable hooks 54 which are separated by a slit 56. The bifurcated lug 52 is inserted into the rectangular hole 50 at each end 20 of the tie 16 and the hooks 54 are temporarily deflected inwardly for passage through the hole 50 and then spring outwardly to engage a bottom surface of the tie 16 and thereby secure the retainer 18 to the tie 16. This embodiment of the retainer 18 also includes a pair of generally circular lobes 58 on either end of a generally rectangular middle portion 60 from which the lug 52 depends downwardly. Each of the generally circular lobes 58 is approximately one inch in diameter and include a 0.203 diameter hole 62 which extends through the retainer 18. Preferably, the retainer 18 is molded from a polycarbonate material commercially available as Celcon.

After the retainer 18 is fastened to the tie 16 in the rectangular hole 50, which assembly may be accomplished at the factory prior to delivery of the components to the construction site, and the tie 16 is seated within the notches 26 of the adjacent panels 12, pins, nails or other fasteners 64 are hammered or otherwise inserted through the holes 62 in the retainer 18 and into the corresponding holes 36 in the retainer plates 28 of the adjacent panels 12. With the fasteners or pins 64 inserted through the retainer 18 and into the adjacent panels 12, the panels 12 are secured in a fixed side-by-side relationship and movement between the adjacent panels 12 is minimized thereby providing a unitary structure for the wall forms 10. Upper and lower holes 36 are provided in each retainer plate 28, only one of which is used at a time. The panels 12 are designed such that they can be inverted and/or reversed. The inner and outer faces 32 and 34 are identical and the upper and lower halves of the panels 12 are mirror images of each other so that the panel 12 can be reversed top to bottom and inside to outside or the like.

It will be appreciated by one of ordinary skill in the art that the tie and retainer system according to this invention can be easily installed on the panels 12 at the construction site with a minimal amount of effort and time. As a result, sturdy and structurally rigid wall forms 10 are easily and efficiently constructed with this invention so that concrete 22 can be poured between the spaced wall forms 10 and allowed to harden or cure into a concrete wall. After the concrete 22 is hardened, the wall forms 10 are disassembled, as will be described, so that the panels 12 can be reused.

Figure 5:
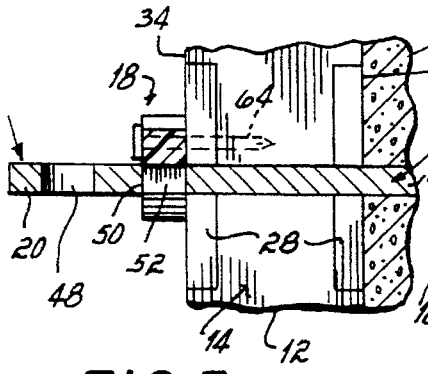
FIG. 5 is a cross-sectional view taken along line 5—5 of FIG. 4.
Figure 6:
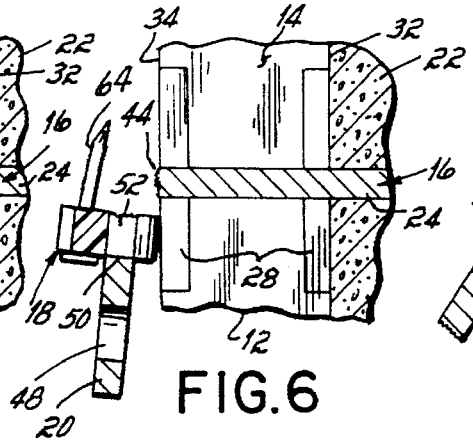
FIG. 6 is a view similar to FIG. 5 showing the first frangible section of the tie and retainer being broken away from the wall form for the disassembly of the wall forms.
Figure 7:
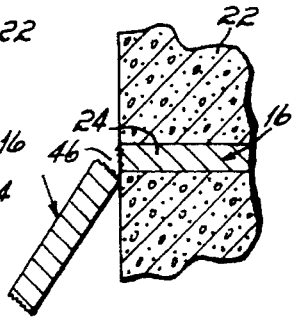
FIG. 7 is a view similar to FIG. 6 with the panels removed from the poured concrete wall and the second frangible section of the tie being broken away.

As shown in FIGS. 5–7, the first frangible section of each tie 16 is fractured along line 44 by a worker with a hammer or the like by impacting the outer end 20 of the tie 16 (FIG. 5) thereby removing the first frangible section and retainer 18 from the wall form assembly (FIG. 6). The pins or fasteners 64 are preferably pulled from the panels 12 when the first frangible section is fractured. As a result, it will be appreciated that removal of the connecting hardware for the panels 12 can be accomplished very quickly and easily and without concern for collecting the various components of the system for reuse. The ties 16 and retainers 18 are considered to be disposable thereby alleviating any concern for retrieval and collection thereof. Fracturing the first frangible section of the tie 16 along line 44 preferably dislodges the pins 64 from the holes 36 in the retainer plates 28 and panels 12. The retainer 18 which is seated and secured to the first frangible section of the tie 16 is likewise removed from the wall form assembly when the first frangible section is fractured.

After the first frangible section and attached retainer 18 are broken away from each of the panels 12, the panels 12 are pulled off of the remaining portion of the tie 16 and away from the hardened concrete wall and transported for reuse as required. As a result, the face of the concrete wall is exposed with the second frangible section of the tie 16 projecting therefrom. The second frangible section is then broken along line 46 with a hammer or the like (FIG. 7) thereby leaving only the middle portion 24 of the tie 16 embedded within the concrete wall. It will be appreciated that grout or other patch material (not shown) may be applied around the area of the embedded tie 16 at the surface of the wall to provide a more aesthetically pleasing and finished appearance to the concrete wall as required. The wall forms 10 and panels 12 are quickly and easily disassembled by sequentially breaking the first frangible section, removing the panel 12, and breaking the second frangible section away from the tie 16. Further, retrieval and collection time for the components of the connecting hardware for the panels 12 is avoided because the retainers 18 are disposable and most of the ties 16 remain in the wall.

Figure 8:
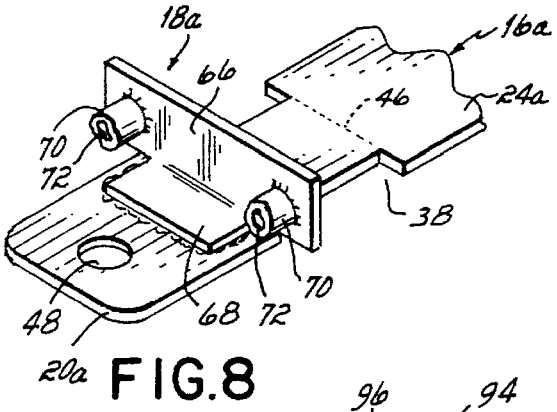
FIGS. 8, 9 and 10 are second, third and fourth presently preferred embodiments, respectively, of retainers according to the present invention.
Figure 9:
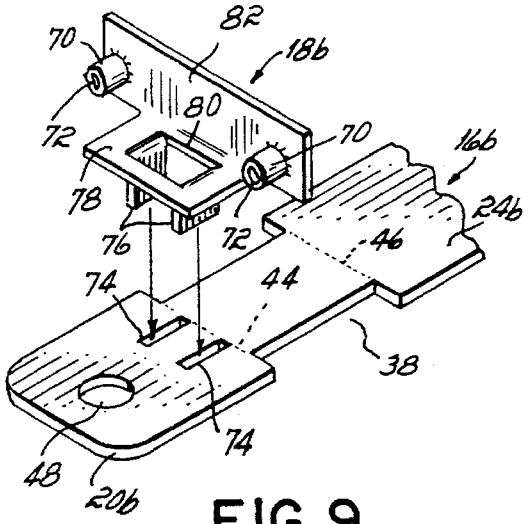
Figure 10:
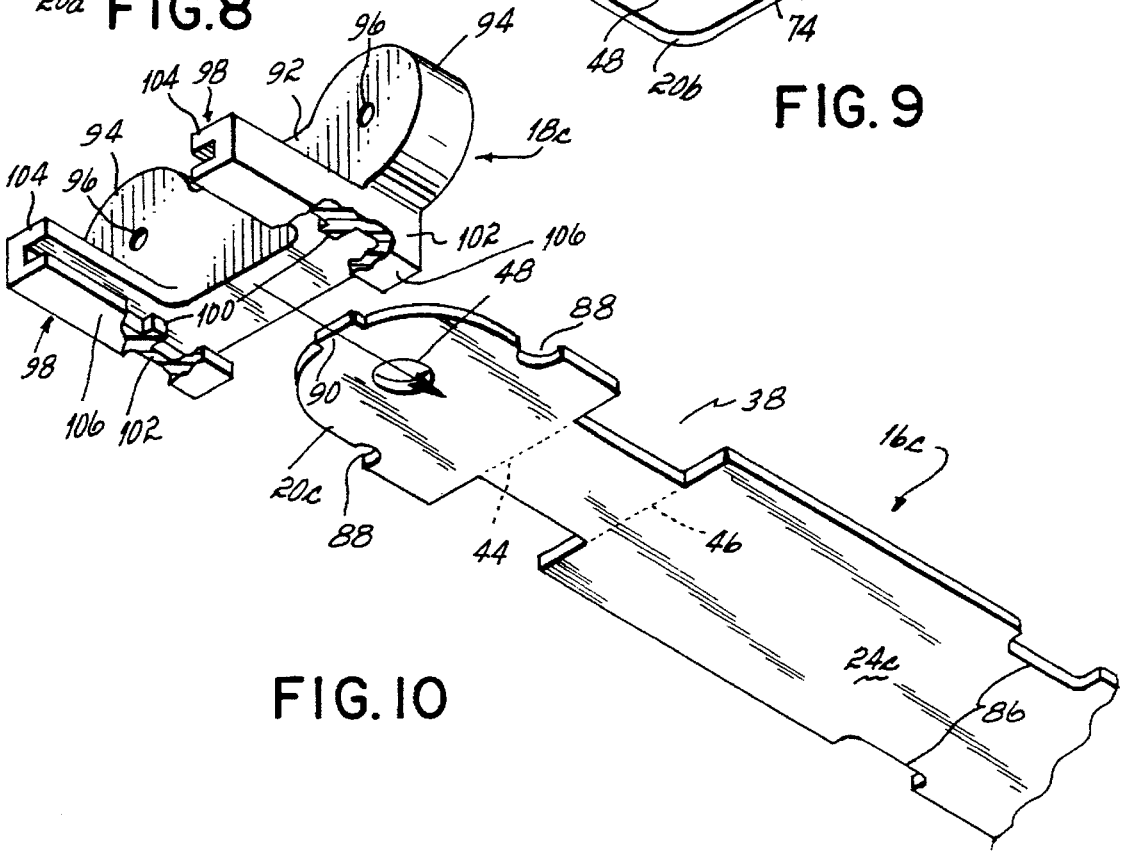

Alternative embodiments of the ties and retainers are shown in FIGS. 8–10. The retainer **18*a* of FIG. 8 is a generally L-shaped channel section having an upper leg 66 and a lower leg 68. The lower leg 68 is preferably one-half inch in width and is spot welded to the upper surface of the tie 16*a*. The upper leg 66 is preferably ½ inch in height and 2³⁄₁₆ inches in length and is positioned on the tie 16*a* to be juxtaposed to the outer face of the retaining plate 28 when the tie 16*a* is secured to the wall form 10. A pair of tubular sleeves 70 provide through holes 72 in the upper leg 66 and are preferably spaced 1.5 inches on center from each other and have an inner diameter of 0.203 inches. Preferably, the sleeves 70 are extruded from the upper leg 66 of the retainer 18*a* which is 20 gage cold rolled steel. The centerline of each sleeve 70 is preferably 0.5 inches above the upper surface of the tie 16*a*. The sleeves 70 provide passages for the pins 64 to be inserted therethrough and into the holes 36 in the retainer plates 28 on the adjacent panels 12 for securing the retainer 18*a* to the wall form panels 12**.

Another presently preferred embodiment for a tie **16*b* and retainer 18*b* combination is shown in FIG. 9 in which a pair of slots 74 preferably measuring 0.09 inches by 0.375 inches are provided in the tie 16*b*. Each slot 74 is adapted to receive therein a tab 76 which is deflected downwardly from a lower leg 78 of the retainer 18*b*. The tabs 76 are preferably bent downwardly from opposing ends of an opening 80 in the lower leg 78 of the retainer 18*b*. After the tabs 76 are inserted into the slots 74 in the tie 16*b*, they are deflected outwardly away from each other onto the bottom surface of the tie 16*b* to secure the retainer 18*b* to the tie 16*b*. An upper leg 82 of this embodiment of the retainer 18*b* shown in FIG. 9 is similar to that of FIG. 8 and includes two tubular sleeves 70 for passage of the pins or fasteners 64 therethrough and into the adjacent panels 12. This embodiment of the retainer 18*b* is preferably formed from 20** gage cold rolled steel.

Another alternative embodiment for retainer **18*c* is shown in FIG. 10 for use with an alternative embodiment of a tie 16*c* according to this invention. The tie 16*c* includes cutouts 38 on each side edge of each end 20*c*. A number of elliptical shaped notches 86, preferably having a 0.5 inch radius on each end and 0.75 inches in length are spaced along each side edge of the middle portion 24*c* of the tie 16*c*. The notches 86 enhance the ability of the curing concrete 22 to grip and hold the tie 16*c*. Spaced from the outer edge of each cutout 38, preferably ⅜ inch, is an arcuate notch 88 preferably having a ³⁄₁₆ inch radius. The terminal end of the tie 16*c* has rounded corners, preferably ⅜ inch radius, for safety reasons to minimize sharp corners and edges. A tab 90 is provided on the outermost end of the tie 16*c* and is a result of the die configuration used for the punching process in manufacturing the tie 16*c***.

The retainer **18*c* shown in FIG. 10 includes an upper portion having a generally rectangular middle section 92 with a circular lobe 94 on each end thereof, similar to the retainer 18 of FIGS. 3 and 4. Holes 96 are provided in each lobe 94 for the pins or fasteners 64. A pair of U-shaped rails 98 are formed on the bottom edge of the retainer 18*c*. Seated within each rail 98 is a detent 100 on an outer wall 102 of the rail 98 between upper and lower walls 104 and 106, respectively. The detent 100 preferably is spaced ⅜ inch from the inner face of the retainer 18*c* and projects 0.2 inches from the outer wall 102 toward the opposing rail 98. The rails 98 are spaced and configured to slide onto the tie 18*c* as shown in FIG. 10 until the detents 100 seat within the notches 88 to secure the retainer 18*c* onto the tie 16*c***, which assembly can be performed at the factory.

Figure 11:
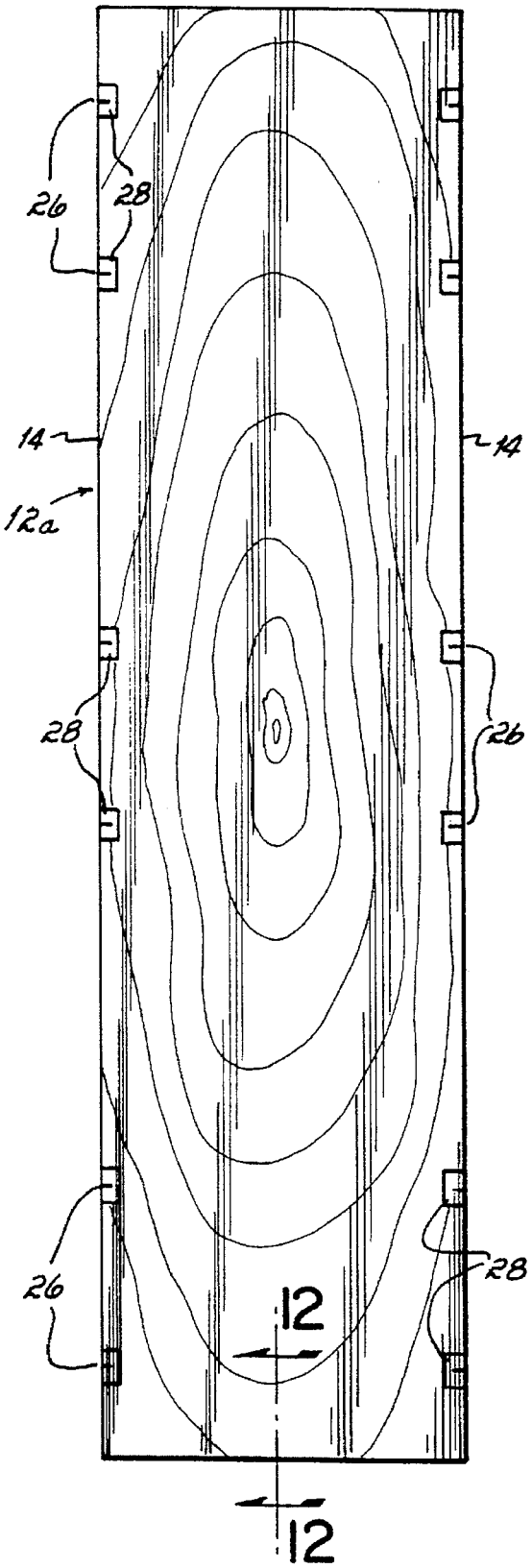
FIG. 11 is a plan view of a presently preferred embodiment of a wall form panel according to this invention.
Figure 12:
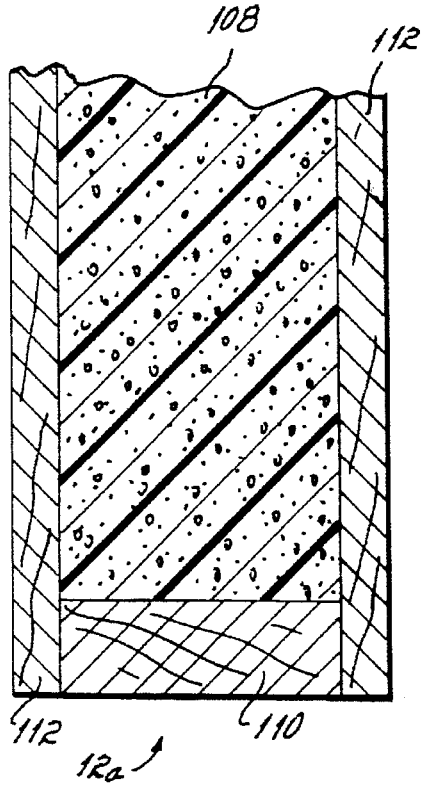
FIG. 12 is a cross-sectional view of an alternative presently preferred embodiment of the wall form panel according to this invention taken generally along line 12—12 of FIG. 11.
Figure 13:
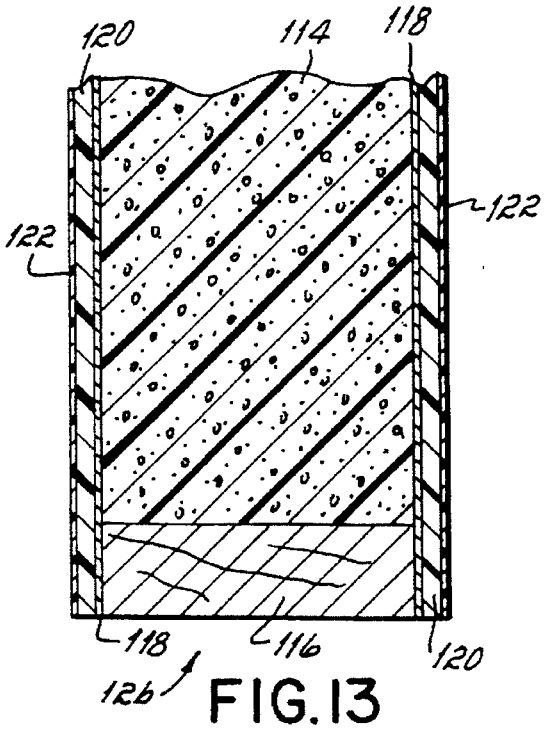
FIG. 13 is a view similar to FIG. 12 of another preferred wall form panel embodiment.

Another important aspect of the present invention is a lightweight and structurally rigid and durable panel which is shown particularly in FIGS. 11–13. It will be appreciated that the panels employed with the alternative tie and retainer embodiments previously described may be of the design shown in FIGS. 11–13 or of any other materials or designs according to this invention. In particular, FIG. 11 is a plan view of a panel **12*a* showing the location of the notches 26 and retainer plates 28 along opposing side edges 14 thereof. In a presently preferred embodiment, the panel 12*a* is eight feet high, two feet wide and two inches thick. In a preferred embodiment, six notches 26 with associated retainer plates 28 on each face 32, 34 are provided along each side edge 14 of the panel 12*a* and are located 6, 18, 42, 54, 78 and 90 inches from either the bottom or the top end of the panel 12*a*. It will be appreciated that the location of the notches 26 of the panel configuration is symmetric so that the panel 12*a* may be used with either face 32, 34 of the panel 12*a* confronting the poured concrete wall and either end of the panel 12*a* oriented upwardly or downwardly. As a result, installation of the panel and assembly of the wall form 10 is much more easily accomplished at the construction site because time and care is not required to properly orient the panel 12***a* as with previously known designs.

The panel 12*a* is preferably two inches thick and in one embodiment as shown in FIG. 12 includes a rigid foam core 108 preferably 1.5 inches thick which is contained by a ¾ inch thick wood, preferably maple, frame 110 extending around the bottom, side and top edges of the foam 108. The frame 110 provides durability, rigidity and support to the foam 108 which is preferably Certifoam 60, Type 7, No. C-578-87A which is commercially available from Diversi-Foam Products.

The embodiment of the panel 12*a* shown in FIG. 12 includes a pair of face sheets 112 which sandwich the foam 108 and frame 110 therebetween. Each face sheet 112 in this embodiment is ¼ inch thick and is preferably high density overlay plywood which is facially adhered to the foam 108 and frame 110 with glue, adhesive or the like. Preferably, the glue is Morad 612 which is commercially available from Morton International Industries. The respective layers are secured with the glue under a pressure of approximately 2.5 psi. The preferred panel 12*a* as shown in FIG. 12 has been tested to withstand a force of 1800 pounds applied at the end of six inch cantilevered section with less than 0.3125 inches of deflection at the end while providing an advantageously light weight, approximately 40 pounds, panel 12*a* which can be easily maneuvered and manipulated by the worker at the construction site or during transportation and storage as required.

Another preferred embodiment of the panel 12*b* is shown in FIG. 13 and preferably includes a 1.65 inch thick rigid foam core 114, similar to that of the embodiment of FIG. 12, which is also captured on the bottom, top and side edges by a ¾ inch thick wood, preferably maple, frame 116. Alternatively, the frame 116 can be a high density rigid polyurethane foam named Last-A-Foam, FR-3730, commercially available from General Plastics Manufacturing Company of Tacoma, Wash. Preferably, the screws 30 which are used to secure the retainer plates 28 to the opposing faces 32, 34 of the panel 12*b* along the side edges 14 thereof extend into the frame 116 or into anchors (not shown) in the frame 116 for secure attachment.

The panel of FIG. 13 comprises a multi-layer composite construction which includes preferably the inner rigid foam core 114 and a pair of aluminum sheets 118, preferably 0.020 inches thick, a shock absorbing material 120, preferably ⅛ inch thick Duron which is available from Wood Fiber Industries, a division of Masonite Corporation and International Paper Company, and a pair of outer protective face sheets 122, each preferably 0.030 inches thick Polycarbonate/ABS, Magnum AG-770 commercially available from Dow. The face sheets 122 may be resin extruded or an equivalent. The respective layers are preferably facially adhered under a pressure of 2.5 psi with glue, adhesive or the like, preferably Morad 612 from Morton International Industries. The embodiment of the panel 12*b* shown in FIG. 13 has been tested to withstand a force of 1800 pounds applied at the end of six inch cantilevered section with less than 0.3125 inches of deflection at the end. The panel 12*b* weighs approximately 30 pounds.

Figure 14:
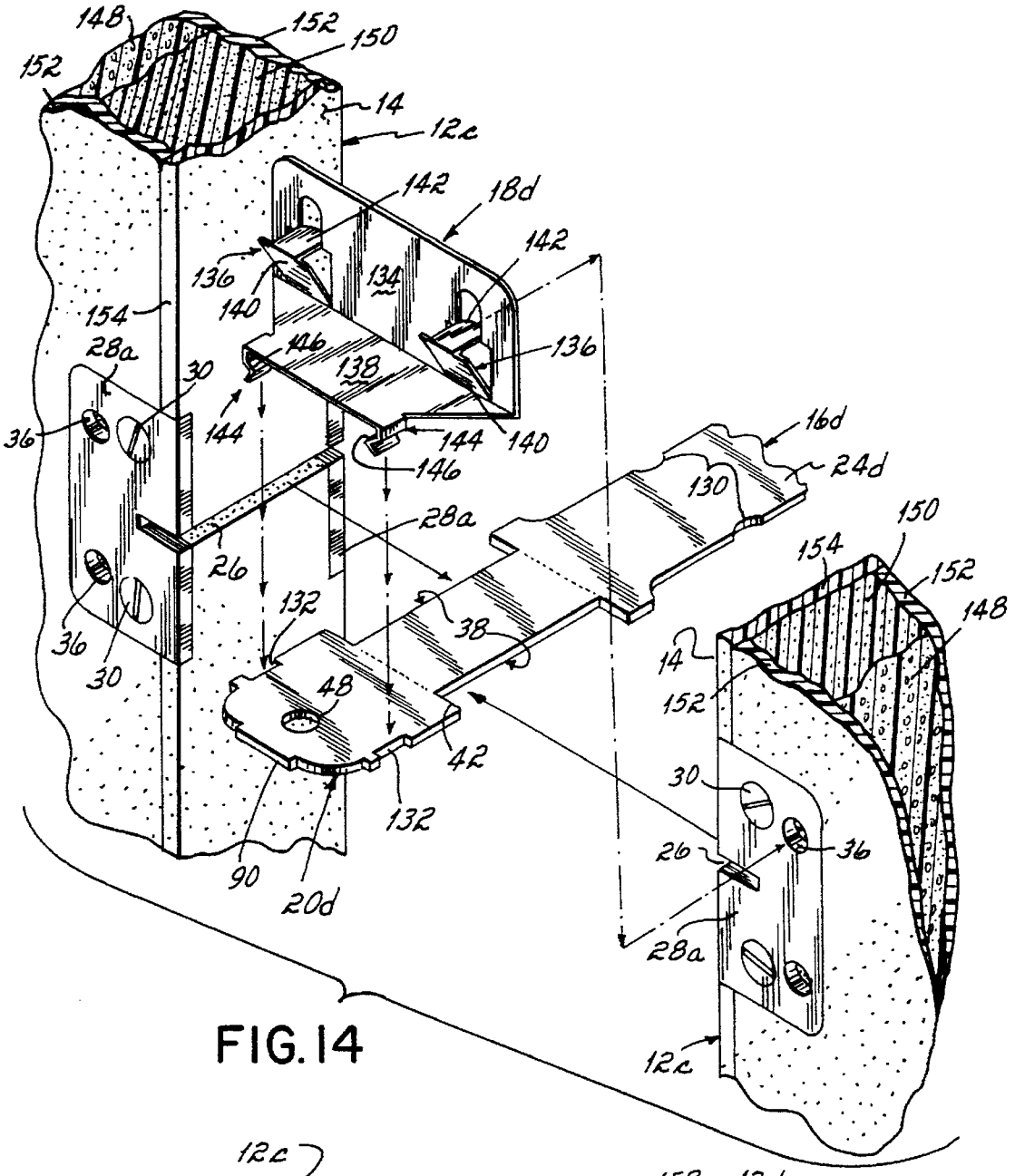
FIG. 14 is a perspective view of another presently preferred combination of panel, tie and retainer designs.

Another presently preferred embodiment of a retainer 18*d* is shown in FIG. 14 for use with an alternative presently preferred embodiment of a tie 16*d* according to this invention. The tie 16*d* includes cutouts 38 on each side edge of each end 20*d*. Preferably, the cutouts 38 are each 1 9/16 inch long and approximately 0.25 inches deep relative to the respective side edges of the tie 16*d*. A number of arcuate shaped notches 130 preferably having a 0.375 inch radius spaced along each side edge of the middle portion 24*d* of the tie 16*d*. The notches 130 enhance the ability of the curing concrete 22 to grip and hold the tie 16*d*. Spaced from the outer edge 42 of each cutout 38, preferably a one-half inch spacing, is a rectangular shaped cutout 132 preferably being about 0.29 inches in length and about 0.125 inches deep. The end 20*d* of the tie 16*d* has rounded corners with preferably a ⅜ inch radius. A tab 90 is also provided on the outermost end of the tie 16*d* as a result of the die configuration used in the punching process for manufacturing the tie 16*d*. A hole 48 is also provided to accommodate a waler system (not shown) as required.

The retainer 18*d* shown in FIG. 14 includes an upper portion 134 having a pair of tabs 136 hingedly connected at a juncture between the upper portion 134 and a lower portion 138 of the retainer. Each tab 136 has a generally rectangular trunk 140 extending angularly upwardly from the lower portion 138 of the retainer 18*d*. Stems 142 connected to the upper edge of the trunks 140 extend horizontally and generally parallel to the lower portion 138 of the retainer 18*d*. Preferably the stems 142 and trunks 140 are punched from the upper portion 134 of the retainer 18*d* and are hinged at the juncture between the upper and lower portions 134, 138 of the retainer 18*d*.

Downwardly extending clips 144 are provided at the outer, rear edge of the lower portion 138 of the retainer 18*d*. The retainer 18*d* is secured to the tie 16*d* by snapping the clips 144 onto the notches 132 at the outer end of the tie 16*d* by forcing the retainer 18*d* onto the tie 16*d* and temporarily deflecting the clips 144 outwardly until a detent 146 on the clip 144 engages the tie 16*d* at the notches 132 and is secured on the lower surface of the tie 16*d*. Preferably, the retainer 18*d* is fabricated from 0.048 inch thick cold rolled steel.

Figure 15:
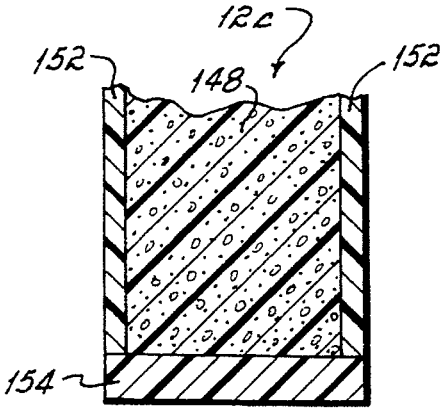
FIG. 15 is a cross-sectional view of the panel design of FIG. 14.

Another presently preferred embodiment of a panel 12*c* is shown in FIGS. 14 and 15. The panel 12*c* includes notches 26 in the side edges thereof which are preferably spaced along the side edges 14 as shown in the previously described embodiment of FIG. 11. The panel 12*c* includes a retainer plate 28*a* on each face of the panel at each notch 26. The retainer plate 28*a* is preferably 0.125 to 0.375 inches thick and either 1050 or 4140 high carbon steel. The plate 28*a* is embedded within the panel 12*c* to provide a flush face for the panel 12*c*. Preferably the retainer plate 28*a* measures approximately 2 inches high and 1 inch wide with the notch 26 positioned approximately 1 inch from the top or bottom and extending 0.33 inches inwardly from the side edge and providing a 0.125 inch opening. Upper and lower screws 30 are used to secure the plate 28*a* to the panel 12*c* and upper and lower holes 36 are also provided in the plate 28*a* to receive therein the stems 142 from the retainers 18*d*. Preferably, each hole 36 is 0.562 inches above or below the centerline of the retainer plate 28*a* and is spaced 0.75 inches from the side edge of the panel 12*c*. With the notches 38 of the tie 16*d* seated within the notches 26 and the retainer 18*d* snapped onto the tie 16*d*, the stems 142 are driven into the holes 36 to hold the adjacent panels together. The stems 142 can be driven into the holes 36 with a hammer or the like so that each of the trunks 140 of the tabs 136 are generally coplanar with the upper portion 134 of the retainer 18*d*.

The panel 12*c* of FIGS. 14 and 15 is a lightweight, structurally rigid and durable panel 12*c* which is preferably 1.5 inches thick in a presently preferred embodiment and includes a rigid foam core 148 preferably 1.25 inches thick constructed of Certifoam 60, Type 7, No. C-578-87A which is commercially available from DiversiFoam Products. The embodiment of the panel 12*c* in FIGS. 14 and 15 also includes a structural foam 150 extending lengthwise proximate the side edges 14 of the panel 12*c*. Preferably, the structural foam 150 is 2 inches in depth and extends the entire height of the panel 12*c* and is a high density rigid polyurethane foam sold under the name Last-A-Foam, FR-3730 from General Plastics Manufacturing Company of Tacoma, Wash. A pair of face sheets 152, preferably each being ⅛ inch thick Duron which is available from Wood Fiber Industries, a division of Masonite Corporation and the International Paper Company, sandwich the foam 148 and 150. A perimeter frame 154 is also provided on the panel 12*c* and is preferably 1½ inches wide and ¼ inches thick on the top and bottom edges of the panel and ⅛ inch thick and 1½ inches wide along the side edges 14 thereof. The perimeter frame is preferably constructed from acrylic/PVC thermoplastic commercially available as Kidex 550. The respective layers of the panel 12*c* are secured with glue under a pressure approximately 2.5 psi as previously described with the other preferred embodiments of the panel 12*c* according to this invention.

Figure 16:
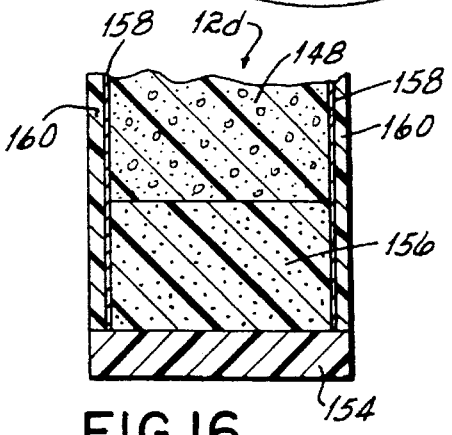
FIG. 16 is a view similar to FIG. 15 of another preferred wall form panel embodiment.

Another preferred embodiment of the panel 12*d* is shown in FIG. 16. The panel 12*d* of FIG. 16 is 1.5 inches thick and includes the inner rigid foam core 148 which is preferably 1.25 inches thick of Certifoam 60 Type 7, No. C-578-87A. An internal frame 156 of structural foam extends around the top, bottom and side edges of the panel 12*d* of FIG. 16 and is preferably 1.25 inches wide and 0.75 inches deep at each portion of the frame 156 and is preferably constructed from Last-A-Foam FR-3730. An outer peripheral frame 154 of preferably Kidex 550 extends around the top, bottom and side edges of the panel 12*d* and is preferably 1.5 inches wide and 0.25 inches thick on the top and bottom edges and 1.5 inches wide, 0.125 inches thick on the side edges 14. The inner foam core 148, and structural foam frame 156 are preferably sandwiched between composite multi-layers which each include an aluminum sheet 158, preferably 0.020 inches thick and an outer protective face sheet 160, preferably 0.080 inches thick of Kidex 550. The respective layers of the panel 12*d* of FIG. 16 are preferably facially adhered under a pressure of 2.5 psi with glue, adhesive or the like as previously described. The embodiment of the panel 12*d* of FIG. 16 has been tested to withstand a force of 1,800 pounds applied at the end of a 6 inch cantilevered section with less than 0.3125 inches of deflection at the end. Advantageously, the panel 12*d* of FIG. 16 measuring 8 feet high, 2 feet wide, and 1.5 inches thick weighs 31 pounds total weight and provides a significantly lighter and more easily maneuvered panel than known concrete wall form panel designs. The tie 16*d*, retainer 18*d*, retainer plate 28*a*, and panel designs 12*c*, 12*d* of FIGS. 14–16 are the presently most preferred embodiments of each component of the poured concrete wall system according to this invention.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A form system for a poured concrete wall, said system comprising:

a first and a second form, said first and second forms being spaced from each other so that concrete can be poured therebetween and hardened to produce the poured concrete wall;

a plurality of panels cooperating to construct each said form, each said panel having spaced side edges and an outer surface, each said panel having at least one said side edge being adjacent to said side edge of an adjacent said panel;

a plurality of notches in each said panel side edge, said notches of said adjacent panels being aligned;

a plurality of ties extending between said spaced forms, each said tie having spaced ends and each said end being seated within a pair of said aligned notches of said adjacent panels of one of said forms, each said end having first and second frangible sections, a portion of each said end extending beyond said outer surface of said panel; and a generally L-shaped retainer on said portion of each said end of each said tie to secure said tie to each said adjacent panel a lower leg of said retainer being secured to said tie such that an upper leg of the retainer is juxtaposed to an outer face of one of said forms;

wherein after the concrete wall has hardened the panels are removed for reuse by fracturing each said tie at said first frangible section and removing said panels from the concrete wall and then fracturing each said tie at said second frangible section for removal from the wall.

2. The system of claim 1 further comprising:

a pair of fasteners on each said retainer, each said fastener securing said retainer to one of said adjacent panels and maintaining said adjacent panels in position relative to each other.

3. The system of claim 1 further comprising:

a pair of cutouts proximate each said end of each said tie, each said cutout mating with one of said aligned notches of said adjacent panels to maintain said wall forms in a predetermined spaced relationship.

4. The system of claim 1 further comprising:

a retainer plate affixed to said panel proximate each said notch, said retainer plate providing added strength to said panel for said tie and retainer coupled thereto; and at least one hole in said retainer plate to accommodate secure attachment of said retainer to said panel.

5. The system of claim 1 wherein said first frangible section is said portion of each said tie which extends beyond said panel outer surface and said second frangible section extends from the concrete wall to said first frangible section.

6. The system of claim 1 further comprising:

a pair of hooks on said retainer, said hooks being adapted to clamp said retainer onto said tie proximate each said end thereof.

7. The system of claim 1 wherein each said panel is a composite panel comprising:

a rigid foam core; and a pair of face sheets.

8. The system of claim 7 wherein said face sheets are polycarbonate and said composite panel further comprises:

a pair of aluminum sheets between which is sandwiched said rigid foam core; and a structural foam frame extending around a perimeter of said rigid foam core.

9. A tie assembly to secure a pair of wall forms in a spaced relationship so that concrete can be poured therebetween and hardened to produce a concrete wall, said assembly comprising:

a tie having spaced ends and configured to extend between the spaced wall forms;

first and second frangible sections on each said end of said tie; and a retainer on each said end of said tie to secure said tie to the wall forms, said retainer having a generally L-shape and a lower leg of said retainer being secured to said tie so that an upper leg of said retainer is juxtaposed to an outer face of the wall form;

wherein after the concrete wall has hardened the wall forms can be removed by fracturing said tie at said first frangible section and removing said wall forms from the concrete wall and then fracturing each said tie at said second frangible section for removal from the concrete wall.

10. The assembly of claim 9 further comprising:

a pair of cutouts proximate each said end of said tie, said cutouts being on opposite sides of said tie and each said cutout mating with a notch in said wall form to maintain said wall forms in a predetermined spaced relationship.

11. The assembly of claim 9 wherein said first and second frangible sections on each said end of said tie are defined at least in part by a cutout in said tie proximate each said end.

12. The assembly of claim 9 wherein the wall forms are constructed by a plurality of serially aligned panels and said tie is located at a juncture between adjacent said panels, the assembly further comprising:

first and second holes in said upper leg of said retainer; and a fastener inserted through each of said first and second holes and adapted to project into the wall form, said first and second holes being located on said upper leg such that said fastener can be inserted in said first hole to project into one of said panels and another of said fastener can be inserted in said second hole to project into an adjacent panel.

13. The assembly of claim 9 wherein said lower leg is welded to said tie.

14. The assembly of claim 9 wherein said lower leg further comprises a tab which is inserted into a slot in said tie and deformed to secure said retainer to said tie.

15. The assembly of claim 9 wherein said lower leg includes a bifurcated lug having a pair of deflectable hooks and said tie has a hole into which said lug is inserted by temporarily deflecting said hooks, said hooks securing said retainer to said tie after said lug is inserted into said hole.

16. The assembly of claim 9 wherein said lower leg comprises a pair of spaced rails to receive therebetween said tie, each said rail having a detent adapted to mate with a notch on said tie to securely fasten said retainer to said tie.

* * * * *